United States Patent [19]

Gaffrig

[11] Patent Number: 4,643,272

[45] Date of Patent: Feb. 17, 1987

[54] MARINE MUFFLER FOR WATER-COOLED INTERNAL COMBUSTION ENGINES

[76] Inventor: James W. Gaffrig, 5212 N. Glenwood Ave., Chicago, Ill. 60640

[21] Appl. No.: 739,551

[22] Filed: May 30, 1985

[51] Int. Cl.[4] ..... F01N 3/04

[52] U.S. Cl. ..... 181/260; 181/239; 181/254; 181/272

[58] Field of Search ..... 181/235–239, 181/254, 260–262, 267, 268, 272

[56] References Cited

U.S. PATENT DOCUMENTS

| | | | |
|---|---|---|---|
| 1,048,435 | 12/1912 | Still | 181/260 |
| 1,709,426 | 4/1929 | Beery | 181/254 |
| 2,069,751 | 2/1937 | Couch et al. | 181/267 |
| 2,455,965 | 12/1948 | Wohlberg | 181/261 |
| 2,725,948 | 12/1955 | Keene | 181/262 |
| 3,296,997 | 1/1967 | Hoiby et al. | 181/235 X |

*Primary Examiner*—Benjamin R. Fuller
*Attorney, Agent, or Firm*—Norman Lettvin

[57] ABSTRACT

An exhaust gas silencing assembly or unit of the wet-type receives the exhaust gases from a water cooled internal combustion engine used to power a water-going vehicle, such as a speed boat, and the coolant water from the water jacket of the engine. The exhaust gas and water mixture may be expelled through a downwardly directed combined exhaust gas and water outlet of the silencing unit, or in response to opening a valve in an exhaust flow tube of the unit, exhaust gases and some of the water may be expelled directly out an outlet opening of the silencing unit. When the water and exhaust gases are expelled downwardly into the turbulent waters and foam of the wake of the boat the level of sound emanating from the silencing unit is substantially minimized. Upon opening of the valve at an outlet end of the silencing unit to provide straight through fluid flow the sound level of the engine is at a maximum, but the back pressure imposed on an engine is at a minimum for providing maximum engine performance. Alternate embodiments of the structure of the silencing unit are disclosed.

21 Claims, 22 Drawing Figures

FIG. 1
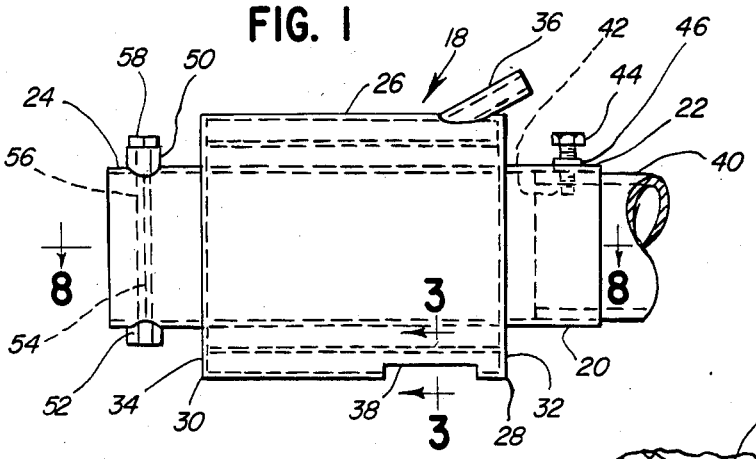
FIG. 2
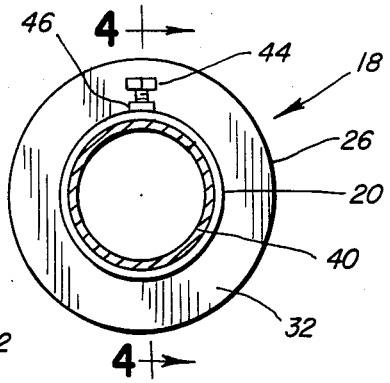
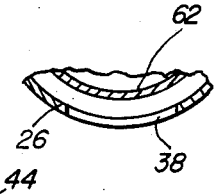
FIG. 3
FIG. 4
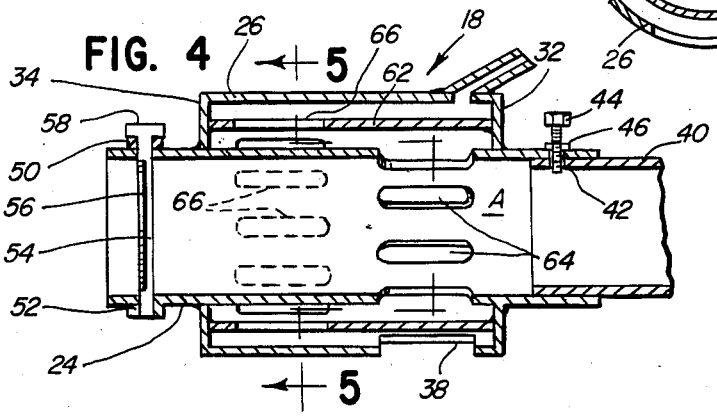
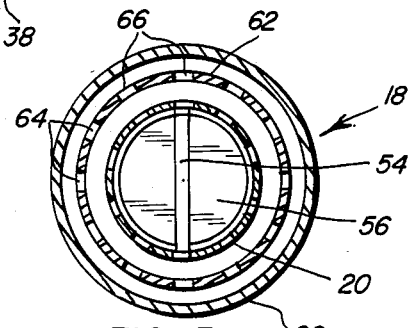
FIG. 5
FIG. 6
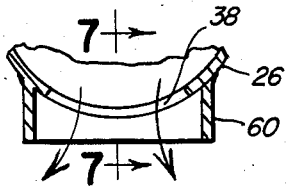
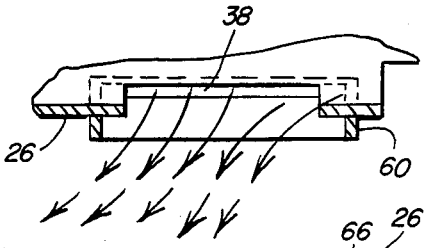
FIG. 7
FIG. 8
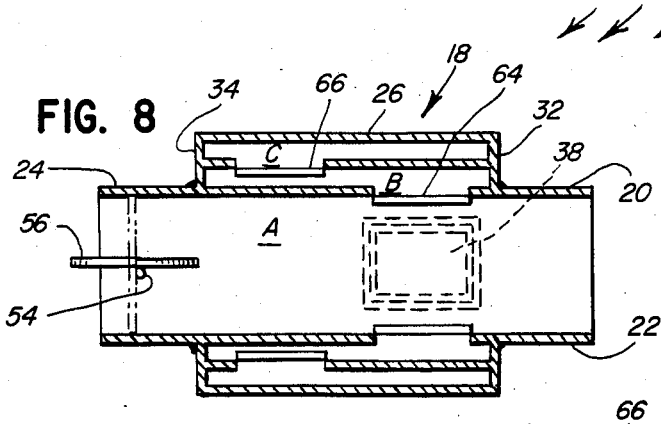
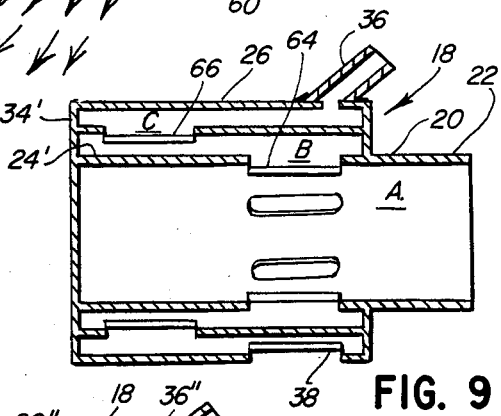
FIG. 9
FIG. 10
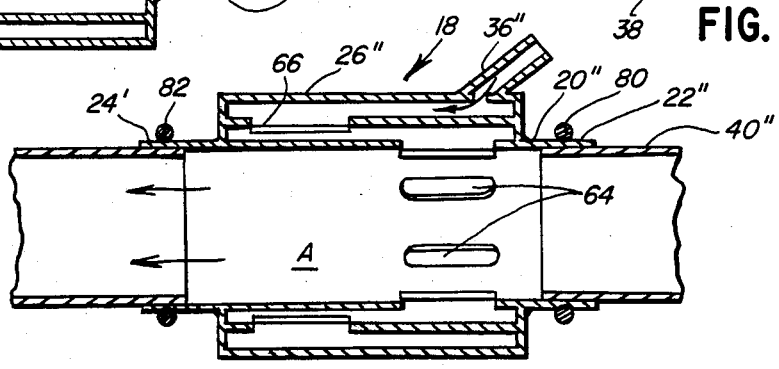

MARINE MUFFLER FOR WATER-COOLED INTERNAL COMBUSTION ENGINES

BACKGROUND OF THE INVENTION

1. Field Of The Invention

This invention relates to wet-type silencers for reducing the exhaust noise of water cooled internal combustion engines in which engine cooling water is mixed with the exhaust gases, such as in marine engines used to power boats.

2. Description Of The Prior Art

Wet-type exhaust systems for water cooled internal combustion engines in which the cooling water of the engine is injected into and entrained, or mixed, with the exhaust gases of the engine are old and well known for use on boats. Such exhaust systems, having a silencing unit, are typically used on highpowered speed boats.

In one prior art silencing arrangement for such exhaust systems a silencing unit having a plurality of axially spaced baffle members is located outboard of the transom of the boat. The silencer is connected in fluid flow engagement with an end portion of an engine exhaust pipe. Exhaust gases and cooling water carried by the pipe pass through a series of spaced openings which essentially define a longitudinally extending central passageway formed by axially aligned central opening in each of the plurality of axially spaced baffles. Under normal conditions a valve at the outlet end of the silencer unit is maintained open to enable the exhaust gas and water mixture to pass straight through the silencing unit, with a marginal amount of the gas/water mixture being expelled radially outward through radially outward extending spaces formed between the axially spaced baffles. When the outlet valve is in an open position, such as under high speed conditions in open water remote from residences and shore lines, the silencer is least effective in reducing noise traveling with, or caused by, the discharging exhaust gases.

When reduced sound levels are desired, or, in some areas, required by law, the valve at the outlet end of, or downstream of, the silencer is closed and substantially all exhaust gases and water are forced to flow radially outward between the axially spaced baffles to achieve maximum reduction of the exhaust sounds. Under such "closed valve" conditions the silencer or muffler causes substantial back pressure and attendant lack of power and efficiency of the engine. Also, the exhaust gas and water mixture is essentially spewed out or sprayed radially out of the exhaust silencer around the entire 360° perimeter of the silencer. This arrangement allows sound waves to radiate outwardly in virtually all directions from the silencer and, due to often being used under low speed conditions, the water radiated outward from the silencer can, under adverse wind conditions, be blown onto occupants of the boat.

Additionally, known prior art commercially available wet-type silencers for such exhaust systems typically suffer from inadequate effectiveness in reducing the exhaust sound to acceptable or legal levels and/or they create unacceptably high levels of back pressure which significantly reduce the fuel efficiency and power capacity of the engine.

SUMMARY OF THE INVENTION

A wet-type exhaust gas sound reducing or silencing unit is provided with an exhaust gas flow tube having an exhaust gas receiving end adapted for being affixed in fluid flow communication with an end portion of an exhaust pipe.

A first and a second annular chamber are arranged concentric with each other and with the flow tube. An outer casing or wall defines the radially outer wall of the second outer annular chamber and the casing is sealed at each of two axial ends to the flow tube.

The flow tube is in fluid flow communication with the first or radially inner annular chamber and the inner annular chamber is in fluid flow communication with the second or radially outer chamber.

A water inlet passageway for receiving cooling water from the cooling jacket of an engine is, in one embodiment, provided in the outer annular chamber. Also, a combined water and exhaust gas outlet opening is formed in the outer casing to enable exhaust gases and water to exit the silencing unit radially downwardly through the outer casing.

A second end of the exhaust gas flow tube may optionally be provided with a valve which can be selectively positioned to allow exhaust gases and water to flow out the second end of the flow tube. When the valve is closed all gas and water entering the muffler or silencing unit is forced to flow through the combined water and gas outlet in the outer casing to provide maximum reduction in the level of sound emanating from the engine.

A variety of embodiments are disclosed to accommodate various features of boats and/or desires of the boat owner or user. The silencer assemblies selectively provide effective sound level reductions while maintaining effective engine power levels.

BRIEF DESCRIPTION OF THE DRAWINGS

FIG. 1 is a side elevation view of the wet-type exhaust silencer of this invention in which the silencer is shown connected to an outlet end portion of an exhaust pipe of a water cooled internal combustion engine;

FIG. 2 is an end elevation view showing the right end of the invention as shown in FIG. 1;

FIG. 3 is a partial sectional view showing a combined water and exhaust gas outlet of the silencer unit shown in FIG. 1, as indicated by the section line 3—3;

FIG. 4 is a full section view of the silencer unit shown in FIGS. 1 and 2, as indicated by the section line 4—4 on FIG. 2;

FIG. 5 is a full section view of the silencer unit shown in FIG. 4, as indicated by the section line 5—5;

FIG. 6 is an alternate embodiment of the combined water and exhaust gas outlet shown in FIG. 3;

FIG. 7 is a sectional side view of the combined water and exhaust gas outlet shown in FIG. 6, as indicated by the section line 7—7;

FIG. 8 is a full section view of the silencing unit shown in FIG. 1, as indicated by the section line 8—8;

FIG. 9 is a full section view of an alternate embodiment of the silencing unit shown in FIGS. 1 and 4;

FIG. 10 is a full section view of an alternate embodiment of the silencing unit shown in FIGS. 1 and 4, in which the silencing unit is of the through flow type;

DETAILED DESCRIPTION OF THE INVENTION

Figure 11:
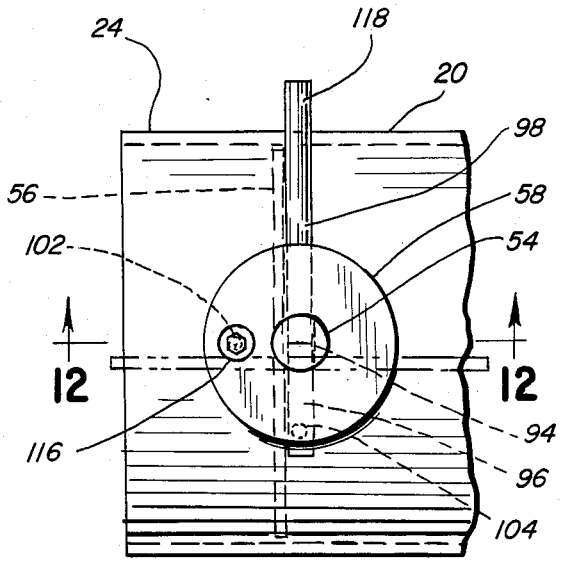
FIG. 11 is an enlarged top plan view of that portion of the silencing unit containing the outlet valve, as shown in FIG. 1.

FIG. 1 is a side elevation view of a coolant water receiving and exhaust gas silencing unit or assembly 18 for silencing or reducing the sound level of exhaust gases expelled from a water cooled internal combustion engine. FIG. 2 is a right end elevation view of the silencing assembly shown in FIG. 1. Silencing assembly 18 is comprised of an exhaust gas receiving tube, or first tube, 20 having a first or gas receiving inlet end portion 22 and a second end portion 24. Tube 20 is preferably formed of a substantially cylindrical wall having a longitudinal axis and defining a flow passage A, as shown.

Intermediate first end 22 and second end 24 of tube 20 an outer casing 26 is provided. Casing 26 is formed of a substantially cylindrical wall, which is positioned concentric with and radially outwardly spaced from the cylindrical wall defining tube 20. Casing 26 has a first end 28 and a second end 30 and, as shown in FIG. 1, the casing extends longitudinally along tube 20 to completely surround a substantial axial portion of the tube 20 between ends 22 and 24. Casing closure means, such as a pair of substantially annular members 32 and 34 are affixed to ends 22 and 24, respectively, of casing 26 and extend radially inward into sealing engagement with the periphery of tube 20. Members 32 and 34 are preferably welded to each the casing 26 and the tube 20 to form an enclosed annular space between the casing and the tube.

A water inlet passageway 36 is provided in an upper portion of casing 26 and a combined water and gas outlet opening 38 is provided in a lower portion of casing 26, preferably substantially diametrically opposed to water inlet 36.

Inlet end 22 of first tube 20 is adapted to be sealingly engaged with an exhaust fluid conveying conduit in fluid flow communication with an engine, such as an engine exhaust pipe 40, as partially shown in FIG. 1. End 22 of tube 20 is sized or adapted to receive an end portion of pipe 40 in a telescoping relationship, substantially as shown. As shown in FIGS. 1 and 2, and better shown in FIG. 4, an engagement opening 42 is provided in a predetermined location adjacent the end of pipe 40 and a removable engaging means, such as threaded bolt 44, is threadedly engaged with a threaded engagement means, such as a nut 46, affixed in a desired location on the wall of tube 20. Nut 46 is aligned with an opening in the wall of tube 20. Installation of silencing unit 18 is accomplished by sliding the inlet end 22 of tube 20 over the end of exhaust pipe 40 and aligning the opening in the nut 46 with the opening 42 in pipe 40. The bolt is then turned into the nut until it extends through each the wall of tube 20 and the wall of pipe 40 to maintain unit 18 mounted on pipe 40, substantially as shown. It is to be understood that other engagement means, such as, for example, a U-clamp, could be used as a substitute for the aligned holes and bolt. However, as it is desirable to have the combined water and gas outlet 38 oriented to direct the water and exhaust gases expelled from the outlet substantially vertically downward into the wake of churning, frothed water behind the boat, a position orienting engagement means, such as the bolt 44 on pipe 20 and coacting openings 42 formed in exhaust pipe 40, is preferred.

Engaged with second end portion 24 of tube 20 is a selectively openable and closable valve means comprised of a pair of valve mounting members 50 and 52 which are affixed to diametrically opposed portions of the wall defining tube 20.

A valve member support shaft 54 extends between and is rotatably mounted or journaled in each of the mounting members 50 and 52. Fluid flow blocking means, such as a valve plate 56, is mounted on shaft 54 for rotation with the shaft. A rotation facilitating and valve position maintaining assembly 58 is affixed to an upper end portion of the valve shaft 54. The valve plate 56 can be rotated with shaft 54 into a gas flow blocking position in tube 20 to force all exhaust gases and water entering unit 18 to flow circuitously through the unit and exit the unit through the combined gas and water outlet 38. Alternatively, the valve plate 56 may be rotated into a non-blocking or open position with respect to tube 20 to enable exhaust gases and water to exit unit 18 through the second end 24 of the tube 20 in a substantially "straight through" flow path.

FIG. 3 is fragmentary sectional view of the combined gas and water outlet 38 shown in FIG. 1, as indicated by the section line 3—3. As shown, outlet 38 is formed as an opening in the wall forming the outer casing 26. FIGS. 6 and 7 show an alternate form of exit opening in which the opening 38 is surrounded by a downwardly extending flow directing means, such as a depending wall 60 which is suitably affixed, such as by welding, to the portion of the wall of outer casing 26 which surrounds opening 38. Wall 60 serves as a flow directing throat to rearwardly, downwardly focus or direct water, exhaust gases, and sound waves caused by the exhaust gases, into the turbulent water and foam typically present immediately behind the boat. Flow of water and exhaust gases from opening 38 through the opening surrounding throat 60 is indicated by flow arrows in FIGS. 6 and 7.

As best shown in the sectional views of FIGS. 4 and 5, an intermediate flow control means, such as annular or cylindrical wall, or second tube, 62 extends longitudinally, surrounding a portion of tube 20 between ends 32 and 34 of outer casing wall, or third tube, 26. Annular flow control member 62 is sealingly affixed or engaged at each of its axial end portions to an end member 32 or 34 by suitable means, such as welding. As shown in FIG. 4, and better shown in FIG. 5, the intermediate cylindrical flow control member 62 is structured and arranged to be coaxial with each exhaust gas flow tube 20 and the outer casing 26. Member 62 is concentric with tube 20 and is sized to substantially equally divide the annular space formed between tube 20 and outer casing 26 into two concentric annular spaces or chambers. The silencing unit (FIG. 8 for example) is sized and arranged to provide an inner circular-cross section, longitudinally extending fluid flow chamber or space A, within tube 20, a first or inner annular, longitudinally extending fluid flow space B which surrounds and is radially outwardly spaced from tube 20 and a second or outer annular, longitudinally extending fluid flow space C which extends radially outward from member 62 and is defined at its outer periphery by outer casing 26.

Preferably, each flow space A, B and C have substantially equal cross-sectional flow areas.

A fluid flow means, such as a plurality, or set, of circumferentially equally spaced openings 64 are formed in the wall defining tube 20 to provide fluid flow communication between flow spaces A and B. Similarly, a fluid flow means, such as a plurality, or set, of circumferentially equally spaced openings 66 are formed in the wall of intermediate member 62 to provide fluid flow communication between the inner annular flow space B and the outer annular flow space C. In one embodiment of the silencer unit in which the cross-sectional flow area of each of the flow spaces A, B and C is in a range of 12 square inches to 13 square inches, nine equally spaced slots about ½ inch in arc width and about 3 inches in length were formed in each the wall of tube 20 and in member 62. The combined cross-sectional flow area of each set of nine flow slots equalled about 13½ square inches. Thus, for each set of nine slots, the flow area of the sum of the slots in a set is equal to and preferably greater than the cross-sectional flow area of the flow spaces the set of slots provide fluid flow communication between. Therefore, each of the flow spaces A, B and C are equally restrictive or more restrictive to fluid flow than the flow slots which provide fluid flow communication between the flow spaces. As best shown in FIG. 4, the flow slots 64 and 66 are longitudinally offset relative to each other. That is, slots 64 are formed in tube 20 near the portion of tube 20 sealingly engaged with annular end member 32 and the slots 66 are formed in member 62 near annular end member 34. Also, as best shown in FIG. 5, slots 64 in tube 20 are circumferentially offset or unaligned longitudinally with the slots 66 formed in member 64. This arrangement provides a substantially sinuous or circuitous fluid flow path for fluid flowing from flow region A, through area B to area C and vice versa.

FIG. 8 is a schematic top plan view of the silencing unit shown in FIGS. 1, 2, 4 and 5, but with the openable and closable outlet end valve 56 shown in the open position. As shown in FIG. 8, exhaust gases flowing into unit 18 may flow substantially unimpeded straight through gas flow tube 20 and directly out through outlet end 24 of tube 20 when the valve plate 56 is rotated to the open position shown in FIG. 8. Some water entering into outer annular flow space C may flow through slots 66 into and through inner annular chamber B and through slots 64 to become entrained with the exhaust gases. Some of the water received in chamber C will flow circumferentially through chamber C and flow out combined water and gas outlet opening 38 formed in outer casing 26 when the valve is in the open or "straight through" flow position.

FIG. 9 is a schematic side elevation view of an alternate embodiment of a silencing unit 18' in which exhaust gas flow inlet tube 20' has its outlet end 24' closed by a substantially disc-shaped imperforate second outer casing end member 34'. All other structural elements of assembly 18' are identical to those of assembly 18, shown in FIG. 8. For those elements which are identical in structure and function the same reference numerals are used on the drawings.

In the silencing unit 18' all the water and exhaust gases which flow into the unit must exit the unit through the combined exhaust gas and water outlet opening 38 formed in outer casing 26. As opposed to the assembly 18 of FIGS. 1 and 3, the unit 18' of FIG. 9 only has a single mode of operation which is comparable to the outlet valve of assembly 18 always being closed.

This embodiment of the invention in FIG. 9 is designed for boats in which, due to local law, the sound level must not exceed a legally specified sound level. Also, this embodiment may be provided for those boat owners who subjectively prefer a relatively quiet running boat under all conditions of use.

FIG. 10 is a side elevation sectional view showing a further alternate embodiment of the muffler. Silencing assembly or unit 18" has a solid outer casing 26" in which no opening is provided to allow water or exhaust gases to exit the unit through the outer casing. Also, outlet end 24" of tube 20" is designed to always provide a through flow passage for both exhaust gases and water. This embodiment is designed to be clamped or sealingly engaged at its inlet end 22" to an exhaust pipe end portion 40" with suitable engaging means, such as a well-known U-clamp 80. Second or outlet end 24" is also sealingly engaged by a U-clamp 82 with an exhaust conveying tube or rearwardly extending tailpipe whereby exhaust gases are passed straight through the flow tube 20" and out through the tailpipe and water enters inlet 36", travels arcuately and longitudinally through outer annular space C, flows radially inward through opening 66, thence longitudinally and arcuately through inner annular space B and finally radially inwardly through flow slots 64 into flow area A of tube 20" to become mixed with and entrained by the exhaust gases.

Figure 12:
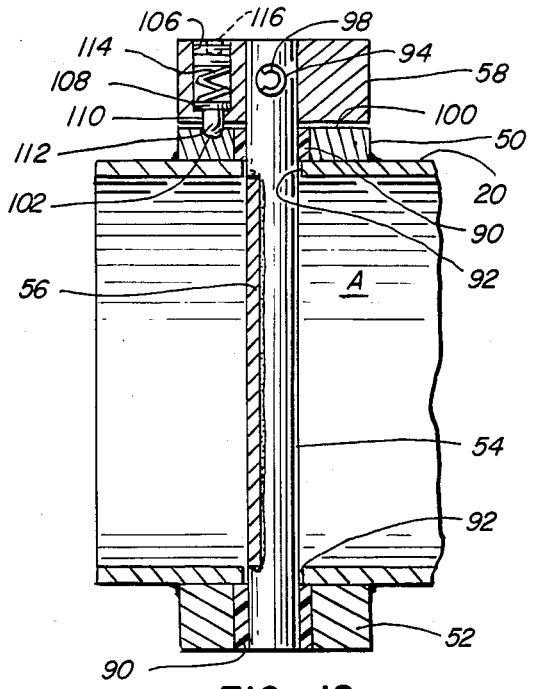
FIG. 12 is a full section view of the valve shown in FIG. 11, as indicated by the section line 12—12.

FIG. 11 is an enlarged top plan view of outlet end 24 of the silencing assembly shown in FIG. 1 showing the outlet valve assembly, and FIG. 12 is a side elevation sectional view of the outlet end shown in FIG. 11, as indicated by the section line 12—12.

Referring to FIGS. 11 and 12, valve mounting shaft 54 extends through flow passage A of tube 20 adjacent outlet end 24 of the flow tube. As shown, shaft 54 is mounted or journaled for rotation in each upper valve mounting member 50 and lower valve mounting member 52. Suitable bearing means, such as noncorrosive bushings 90, are provided between each mounting member and the shaft 54 to enable the shaft to be readily rotated with respect to each mounting member. As shown, shaft 54 extends through a pair of diametrically opposed clearance openings 92 formed in the wall section of tube 20.

Rotation facilitating and valve position maintaining assembly 58 is mounted on an upper portion of shaft 54 which extends above upper mounting member 50. Appropriate engaging means, such as a transverse, diametrically extending opening 94 formed in the upper portion of shaft 54 and a radial bore 96 formed in member 58 are aligned for receiving an engaging member, such as roll pin 98, whereby member 58 and shaft 54 are engaged for rotation with each other. Member 58 is maintained longitudinally affixed with respect to shaft 54. Due to valve plate 56 being affixed to shaft 54 within tube 20 the shaft 54 is unable to move axially with respect to shaft mountings 50 and 52.

In the top surface 100 of shaft mounting member 50 a pair of detents or depressions 102 and 104 are formed. As indicated in FIG. 11, detents 102 and 104 are formed at substantially a 90° angle to each other with respect to the longitudinal axis of shaft 54. Also, the detents are formed substantially equidistant from the longitudinal axis of shaft 54.

Radially outward from the upper portion of shaft 54 a bore 106 is formed in member 58. As best shown in FIG. 12, bore 106 is formed substantially parallel to the longitudinal axis of shaft 54 and has a longitudinal axis which is substantially the same distance from the longitudinal axis of shaft 54 as the detents 102 and 104 are. Bore 106 extends only partially through member 58 and has a terminal end portion 108. A smaller bore 110 extends from terminal end 108 of bore 106 downwardly and forms an abutment or shoulder at lower end 108 of bore 106.

A headed pin having a downwardly extending shaft with a rounded end 112 extends through bore 110 whereby the rounded end is in contact with the top surface 100 of mounting member 50. A biasing means, such as a helical spring 114 is positioned within bore 106 and is maintained compressed against the head of the pin by appropriate means, such as threaded set screw 116.

As shown in FIG. 12, the spring 114 resiliently urges curved end 112 of the pin into a detent such as detent 102 to maintain valve plate 56 on shaft 54 in a desired open or, as shown in FIG. 12, closed position. Placing a rotational force on member 58, such as by manually grasping a portion 118 of roll pin 98 which extends radially outward from member 58 causes the rounded end 112 of the pin to be cammed upward against the resilient urging of spring 114 to allow member 58, shaft 54 and valve plate 56 to rotate with respect to shaft mounting members 50 and 52. Upon sufficient rotation of member 58 in, as shown in FIG. 11, a counterclockwise direction, the end 112 of the pin will be resiliently urged into detent 104 and valve plate 56, as indicated in phantom in FIG. 11, will be maintained in an open position for enabling fluid flow through outlet end 24 of flow tube 20.

Figure 13:
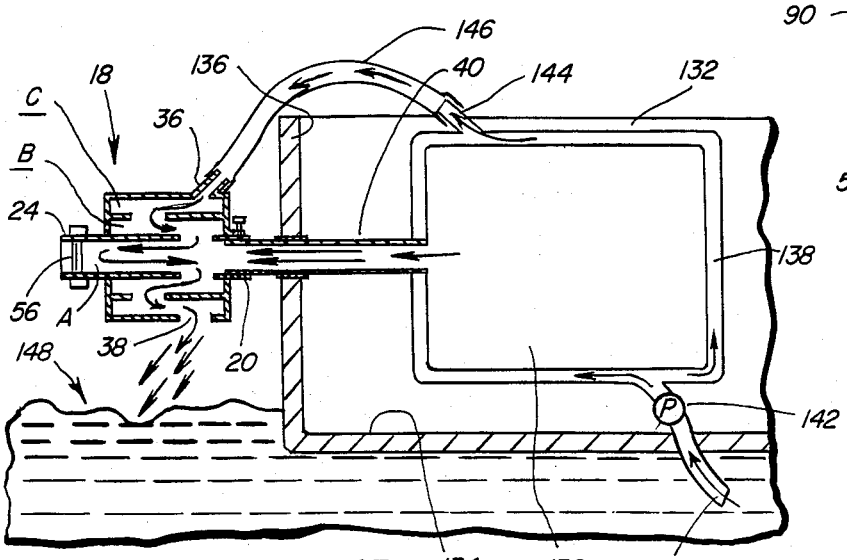
FIG. 13 is a side elevation view schematically showing a silencing unit of this invention, such as the silencing unit shown in FIG. 1, mounted in an operative position on the outlet end of an exhaust pipe of a water cooled internal combustion engine used to power a partially shown speed boat and illustrating by flow arrows the flow of water and exhaust gases through the silencing unit when the outlet valve is closed.

FIG. 13 shows in a diagrammatic side elevation view a silencer unit assembly 18, of the type shown in FIGS. 1 and 2, in which the unit is shown operatively mounted on the exhaust pipe 40 of a water cooled internal combustion engine 130. Engine 130 is mounted in a boat hull 132 having a bottom member 134 and a transom 136. A water jacket 138 is appropriately engaged with engine 130. Water jacket 138 has a water intake means 140, which may include a water pump 142 to cause water to flow through jacket 138. A water outlet means 144 is provided from the water jacket 138.

Water jacket outlet 144 is connected in fluid flow communication with water inlet passage 36 of silencer assembly 18 by appropriate conduit means, such as a resilient tube or hose 146. Upon forward motion of the boat normally caused by a propeller (not shown) drivingly engaged with engine 130, a wake generally designated 148 is formed to the rear of transom 136 and below combined gas and water outlet 38 of unit 13. The wake 148 is typically comprised of an area of frothed and turbulent water created by the rotary action of one or more propellers. Consequently the wake tends to effectively absorb, rather than reflect, sound waves.

As indicated by the flow arrows, with outlet valve plate 56 closed at outlet end 24 of unit 18, water entering the unit may flow circumferentially through outer annular space C to outlet 38 and also longitudinally through outer annular space C and inner annular space B and into flow space A of flow tube 20 via slots 66 and 64. Exhaust gases flowing from engine 130 through exhaust pipe 40 flow through flow space A of flow tube 20, and must flow radially outward through inner annular chamber B and outer annular chamber C via slots 64 and 66 to outlet 38. The water and exhaust gases are mixed with each other as they simultaneously flow through the silencing unit from their respective inlet portions 36 and 20, respectively, to the outlet 38. Consequently, the exhaust gases are cooled by the water and because of the sinuous flow path the mixture is forced to follow through the structure of the muffler serves to effectively silence the sound level of the exhaust gases with minimal back pressure. The back pressure is minimal because each of the annular flow chambers and the series of slots placing them in fluid flow communication with tube 20 and each other provide a fluid flow passage equal to, or greater than the flow area of flow passage A of tube 20. Similarly, outlet 38 preferably has a cross-sectional flow area at least equal to the cross-sectional area of flow passage A defined by the interior of flow tube 20.

Additional effective silencing is achieved because the exhaust gases and water exiting unit 18 through outlet passage 38 are directed downwardly into the sound wave absorptive wake 148 of the boat 132. Often one or more V-8 type engines are used to power boats and a separate exhaust pipe and silencing unit may be provided for each engine or for each bank of cylinders of each engine. Thus, for a boat powered by two V-8 engines, four silencing units would often be provided to treat the exhaust gas/coolant water fluid flows.

Figure 14:
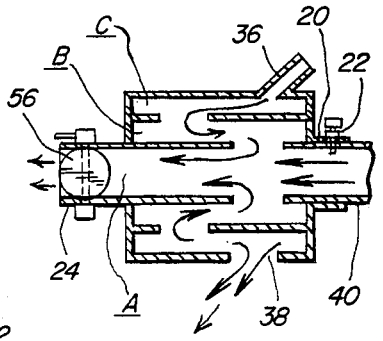
FIG. 14 is a side elevation view schematically illustrating the flow of water and exhaust gases through the exhaust silencing unit shown in FIG. 13 when the outlet valve is open.

FIG. 14 shows diagrammatically the silencing unit 18 shown in FIG. 13 in which the valve plate 56 is in the open position. In this mode of operation, as indicated by the flow arrows most of the exhaust gases will pass directly through tube 20 from inlet end 22 to outlet end 24 and be expelled out outlet end portion 24. Water may flow circumferentially through outer annular chamber C from water inlet passage 36 and exit the unit through outlet 38. A portion of the water may flow circumferentially and longitudinally through chamber C, radially through slots 66, circumferentially and radially through chamber B and radially through slots 64 to enter flow area A of tube 20 where the water taking this flow path will be entrained with the exhaust gases and flow out outlet end 24 of tube 20. Conversely, sound waves caused by, and traveling down the tube 20 with, the exhaust gases discharged by the engine may travel radially out slots 64, longitudinally and circumferentially through chamber B, radially through slots 66 and longitudinally and circumferentially through chamber C to have their sound energy dissipated by mechanical entrapment, reverberation and sound energy and temperature dissipating comingling with the water. In this mode of operation the sound level will be at a maximum but often subjectively pleasing level and the back pressure will be at a minimum to provide maximum engine power level. This "open outlet valve" mode of operation will normally be used only in open water remote from residences and occupied shorelines, or the like.

Figure 15:
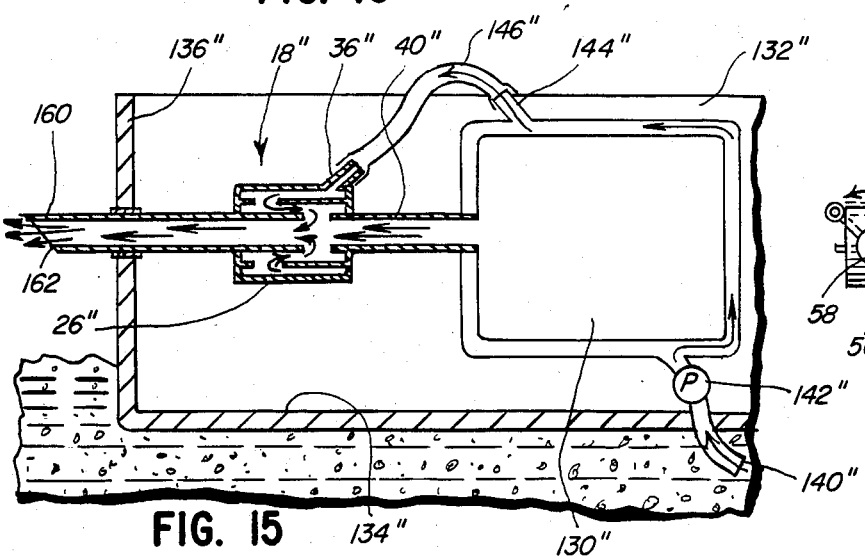
FIG. 15 is a side elevation view of the silencing unit shown in FIG. 10 schematically illustrating the silencing unit operatively mounted in an exhaust system in a partially shown boat.

FIG. 15 is a diagrammatic side elevation view of the silencer assembly 18'' shown in FIG. 10 with some details omitted, showing this alternate embodiment in a typical operative arrangement. FIG. 15 shows a water cooled internal combustion engine 130'' mounted in the hull 132'' of a boat having a bottom portion 134'' and a substantially transverse rear member or transom 136''. Engine 130'' is surrounded by a water jacket 138'' having a water intake or inlet means 140''. A water pumping means, such as water pump 142'' may be provided to draw water through intake 140'' and impel the water into and through water jacket 138''. Water jacket 138'' is provided with a water outlet means 144''.

An exhaust gas pipe 40'' extends rearward from engine 130''. Located within the confines of the hull 132'' between engine 130'' and transom 136'' a silencer assembly 18''. The inlet end 22'' of sliencer 18'' is sealingly engaged in fluid flow communication with the engine exhaust pipe 40''.

A fluid flow means, such as a tailpipe 160 is sealingly communicated with outlet end of flow tube 40''. As shown, tailpipe 160 extends through an opening in the transom 136'' and terminates in an outlet end portion 162 located rearwardly of the transom 136''.

Due to its being located inboard of hull 132'', assembly 18'' has no outlet opening in its outer casing 26''.

Consequently, all exhaust gases pass straight through tube 40'' and tailpipe 160 and exit tailpipe 160 to the rear of the transom at terminal end 162 of tailpipe 160.

A water carrying conduit, such as a resilient tube or hose 146'' is connected between water jacket outlet 144'' and the water inlet passage 36'' of silencer 18''. Water flowing into unit 18'' through passage 36'' must therefore flow through each of chambers C and B and into flow space A of tube 160 where it mixes with and is entrained by the exhaust gases flowing through flow space A of tube 20 and is expelled out end 162 of the tailpipe 160. In this embodiment the mixing of the exhaust gases and the water have a silencing effect on the sound level of the exhaust gases. Also, as in the other embodiments, chambers B and C serve as sound resonating or buffing chambers and thus serve to reduce the level of exhaust gases. This arrangement provides a means of mounting the silencer of the boat inboard and provides high performance of the engine and effective reductions in the sound levels of the engine exhaust gases.

Figure 16:
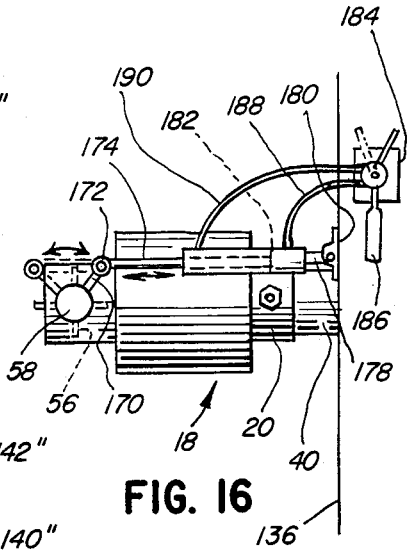
FIG. 16 is a top plan view of the silencing unit shown in FIG. 13 in which the unit is mounted for operation on a partially shown boat and a remote control valve actuating system is provided to open and close the valve.

FIG. 16 is a top plan view of a silencing unit 18, mounted on a boat substantially as shown in FIG. 13 in which valve rotation member 58 is provided with an operator arm means, such as operator arm 170. A power source, such as a fluid operated cylinder has a first end, such as end 172 of a cylinder rod 174 pivotally engaged with arm 170. Cylinder rod 174 is engaged for reciprocation within a cylinder body 176 having an end 178 pivotally connected to a mounting means, such as a mounting bracket 180, that is fixedly mounted on an appropriate surface or base, such as a rear surface of transom 136, substantially as shown. Operatively associated with cylinder rod 174, is a hydraulic actuator 182, for selectively moving rod 174 selectively in opposite directions, one end of actuator 182 being pivotly secured to a mounting bracket 180 that is fixedly mounted on an appropriate support such as the rear surface of transom 136.

Remote from transom 136 at a convenient location within the boat, such as the cockpit, is provided a cylinder control means comprised of a valve means, such as a two way valve 184 which is connected to a fluid power source, such as a source of compressed air 186. A first fluid carrying conduit 188 connects cylinder body 176 on a first side of the piston 182 with valve 184. This arrangement enables valve plate 56 to be rotated to a desired open or closed position from the control area of the boat and eliminates the necessity of a person on the boat having to go to the rear of the boat and manually rotate each outlet valve to a desired position.

On boats with a plurality of silencing units each of the silencers could have a fluid cylinder arrangement as shown in FIG. 16 in which the cylinders would be connected in parallel fluid power circuitry to valve 184 and all outlet valves would simultaneously be actuated by appropriate manipulation of valve 184.

Alternatively, each of the silencer unit outlet valves could be mechanically linked together whereby any one of the outlet valves provided with a fluid cylinder and a control valve 184 could be used to open or close all of the outlet valves simultaneously.

In one embodiment of the silencer assembly 18 shown in FIGS. 1, 2, 3, 4 and 5 fluid flow tube 20 was a cylindrical tube about four inches in diameter and having a longitudinal length from inlet to outlet end of about thirteen inches. Outer casing 26 was a cylindrical sleeve or annular wall about eight inches in length and having a diameter of about seven inches. Casing 26 was positioned substantially concentric with tube 20 with its leading end 32 longitudinally spaced about four inches down tube 20 away from inlet end 22. A pair of annular members 32 and 34 were sealingly welded circumferentially to each the outer wall of tube 20 and a casing end enclosed the annular space between the tube and the casing. An intermediate cylindrical wall member 62 having a diameter of about five and three quarters inches and a nominal length of eight inches was positioned concentric with tube 20 within the annular space between the tube and the outer casing to substantially divide the annular chamber into outer annular flow chamber C and inner annular flow chamber B.

In intermediate annular member 62 nine fluid flow openings about three inches in length and about one half inch in width were formed equally spaced around a portion of the tube beginning about one half inch forward of the rear wall or end 34 of the outer casing. In the cylindrical wall 32 of tube 20 nine fluid flow slots or openings about three inches in length and one half inch wide were formed equally spaced around the wall with the leading longitudinal ends of the slots being formed about one half inch downstream from front wall or end 32 of casing 26.

A valve shaft 54 was mounted for rotation in valve mounts 50 and 52 adjacent outlet end 24 of tube 20, substantially as shown in FIGS. 4, 11 and 12. Valve plate 56 was welded to the shaft 54 for rotation with it.

In substantial alignment in the same plane as shaft 54, a water inlet tube and passage 36 were provided in a forward portion of casing 26. Also, in substantially the same plane the engaging and position maintaining bolt 44, threaded member 46 and opening 42 were provided in tube 20 adjacent inlet end 22.

Lastly, a combined water and gas outlet opening 38 being about four inches in length and about three and one half inches wide was formed centered about the same diametrical plane as water inlet 36 but positioned with its circumferential center substantially diametrically opposed to inlet 36. The leading edge of outlet 38 was formed about three quarters of an inch downstream from end wall 32 of casing 26. Thus, fluids moving longitudinally through outer annular chamber C from end 34 toward end 32 tend to, in the area adjacent the opening, impinge on the interior surface of end 32 and be deflected downwardly and rearwardly through outlet opening 38.

In the unit having the above described dimensions the cross-sectional fluid flow area of each passage A, B and C was in a range of about twelve to thirteen square inches, the cross-sectional fluid flow area of each set of nine slots is about thirteen and one half square inches and the cross-sectional area of outlet 38 is about fourteen square inches.

The silencing unit was substantially completely formed of stainless steel to resist corrosion.

Figure 17:
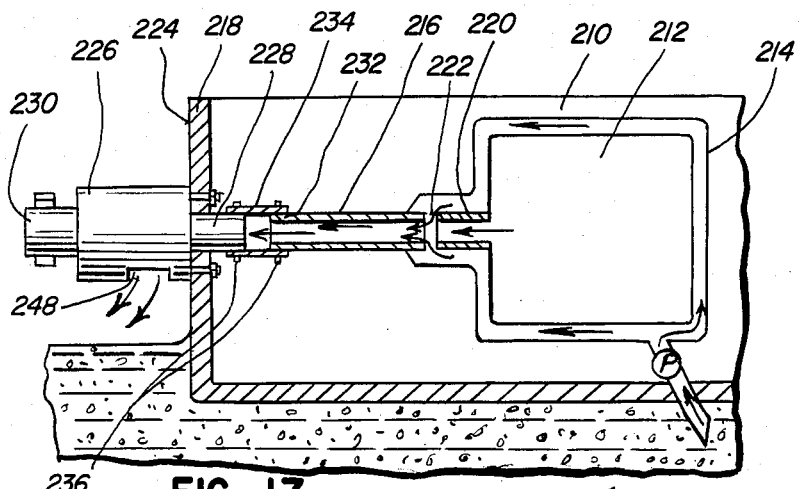
FIG. 17 is a side elevation view schematically showing an alternate embodiment of the silencing unit of this invention mounted in an air operative position in a partially shown speed boat having an internal combustion engine of the type which injects or introduces cooling water into the exhaust gas pipe immediately downstream of the engine.

FIG. 17 is a side elevation view diagrammatically illustrating a portion of a boat hull 210 having an internal combustion engine 212. Engine 212 is provided with an appropriate cooling water means, such as a water jacket 214. An exhaust gas pipe 216 is placed in fluid flow communication with the cylinders of the engine to carry exhaust gases toward the stern or transom 218 of the boat 210. Adjacent its engine connected end 220 pipe 216 provided with water receiving openings 222 which allow cooling water to flow from the water jacket 214 into the exhaust pipe 216. This arrangement causes the cooling water of the engine to be ejected into and entrained with engine exhaust gases relatively close to the engine.

Affixed to an outboard end surface 224 of transom 218 is a silencing assembly, such as the assembly 226 having an inlet end portion 228 and an outlet end portion 230. Inlet end 228 is connected to a second end 232 of the exhaust pipe 216 by an appropriate fluid conveying and vibration isolating or absorbing means, such as a resilient conduit member 234. Member 234 is sealingly engaged with each of the assembly 226 and exhaust pipe 216 by a plurality of circumferential clamps 236.

Due to the cooling water being injected into the exhaust gas stream within the exhaust pipe 216 immediately downstream of the engine no water inlet comparable to inlet 36 of unit 18 for example, is necessary for silencing units, such as the unit 226. However, other than the elimination of the inlet 36 and the mounting structure, the structure and operation of a unit 226 would be identical to an assembly 18.

In the embodiment shown in FIG. 17 silencer assembly 226 is shown rigidly mounted to the transom 218 of the hull 210.

Figure 18:
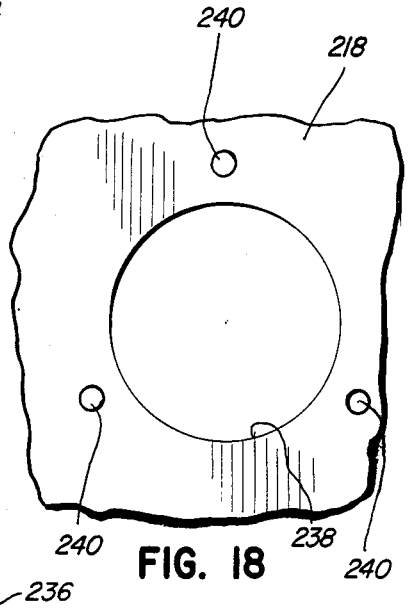
FIG. 18 is a rear elevation view of a portion of the transom of the boat shown in FIG. 17, prior to installation of the silencing unit.

As best shown in FIG. 18, which showns a rear plan view of a portion of the transom 218 prior to mounting an exhaust unit on it, an opening 238 at least as large as, or preferably somewhat larger, in diameter than the diameter of inlet portion 228 of unit 226 is provided in the transom. Equally spaced radially outwardly, preferably in a circular pattern, about the opening 238 are a plurality of threaded fastener receiving openings 240.

Figure 19:
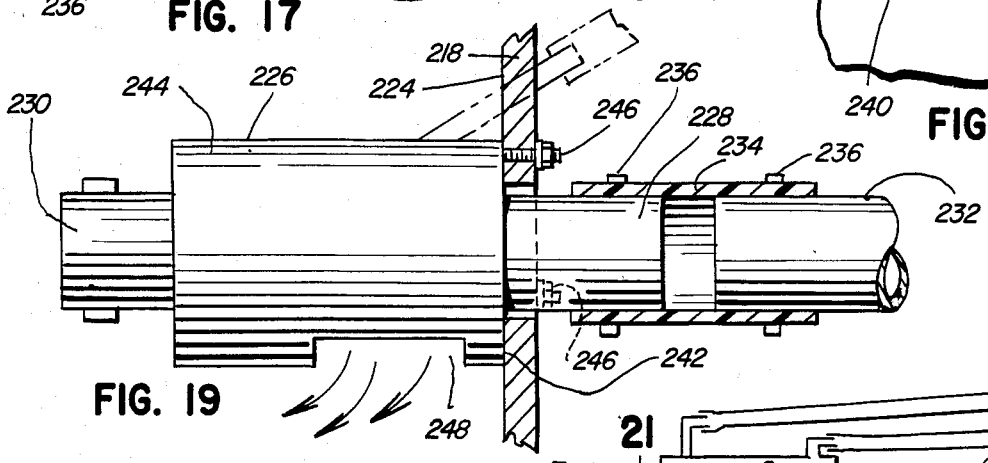
FIG. 19 is an enlarged side elevation view of the silencing unit shown in FIG. 17.

Referring to FIG. 19, there is affixed, such as by welding, to the annular inlet end 242 of the outer shell or casing 244 of unit 226, a plurality of engaging means, such as threaded studs 246. For the hole pattern shown in FIG. 18 three such studs having the same equally spaced relationship in the same circular pattern of the holes 240 would be provided on the inlet end of the casing. The holes 240 and studs 246 would be arranged to assure that the exhaust gas and water exit or outlet opening 248 of unit 226 would be directed downwardly.

Inlet end portion 228 is inserted through opening 238 and, with outlet 248 directed downward, each of the studs 246 are aligned with one of the holes 240 and the unit is slid forward to bring the casing end 242 adjacent surface 224 of the transom 218. Appropriate fastening means, such as a nut 225, is placed on each stud and tightened to secure unit 226 to transom 218 in a substantially rigid manner.

A portion of resilient conduit 234 is used to place the second end 232 of exhaust pipe 216 in sealed fluid flow engagement with the inlet end 228 of unit 226. A plurality of circumferential clamps 236 are used to seal the resilient conduit 234 to each of the pipes it connects. The resilient conduit 234 serves to isolate the transom and silencer unit 226 from vibrations of the engine 212. This structure for engaging a silencing unit to a transom can be used for any of the silencer embodiments shown in FIGS. 1 through 14 and 16 may be mounted to a hull in the above described manner.

For those arrangements having a water jacket with an outlet 144 which is connected to a water inlet 36 of silencing unit, as shown in FIG. 13, an opening would be suitably provided in the transom to accommodate the inlet and conduit, substantially as indicated in phantom lines in FIG. 19.

Similarly, any of the units, such as silencing unit 18, having a water inlet 36 could be used on an engine, such as engine 212 by merely plugging the inlet end of the outer casing water inlet 36 of these units. The inlet member 36 may be readily closed at the time of installation by a suitable welded cap, merely by welding it closed or by clamping and welding it closed.

Figure 20:
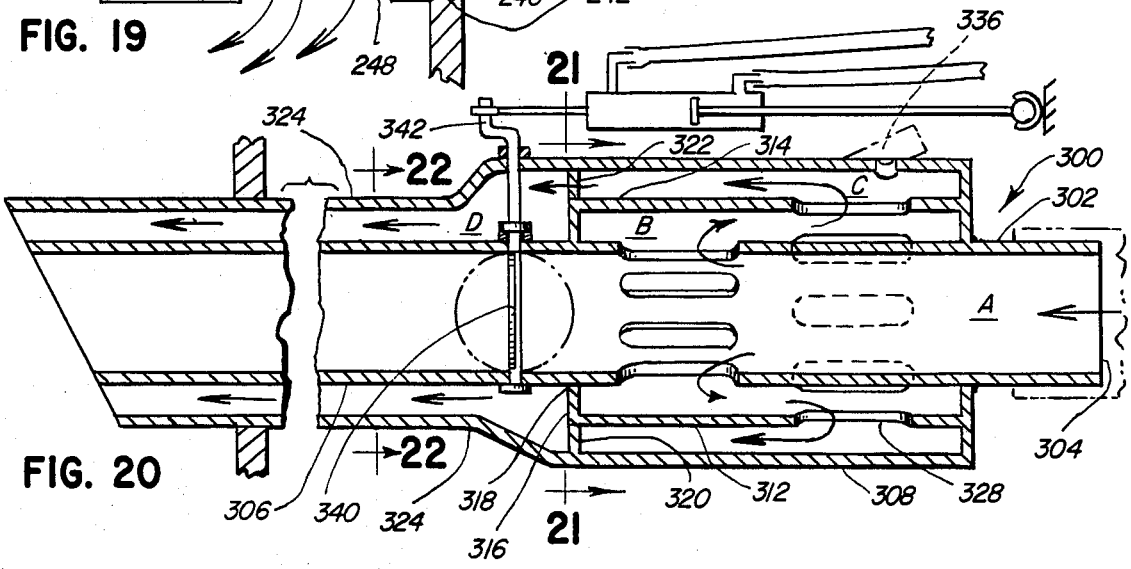
FIG. 20 is a full side section view of another embodiment of a silencing unit of this invention.
Figure 22:
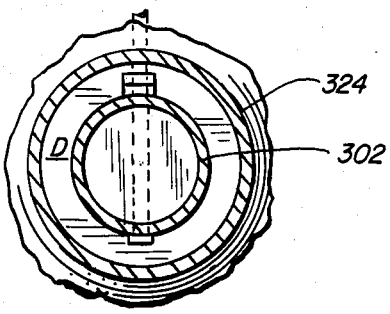
FIG. 22 is a sectional view of the silencing unit shown in FIG. 20 as indicated by the section line 22—22.
Figure 21:
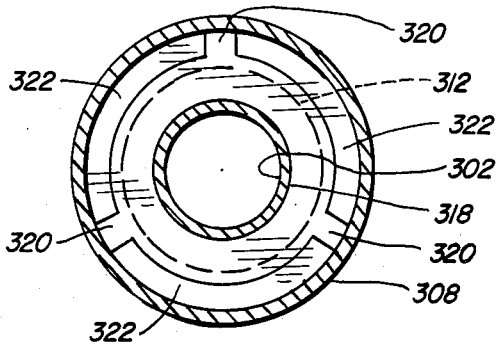
FIG. 21 is a sectional view of the silencing unit shown in FIG. 20 as indicated by the section line 21—21.

FIGS. 20, 21 and 22 show another embodiment of a silencer assembly or unit of this invention. Referring to FIG. 20, a silencer assembly 300 is comprised of a central gas flow tube 302 having an inlet end 304 and an outlet end portion 306. Concentric with and radially outwardly spaced from the tube 302 is an outer shell or casing 308 having a first or inlet end annular seal member 310 which is sealingly engaged to both casing 308 and tube 302. An annular chamber is formed between the outer periphery of the tube 302 and the inner surface of the cylindrical outer shell 308. A cylindrical intermediate member 312 is disposed within this annular space substantially equally spaced between casing 308 and tube 302 to form two concentric annular spaces B and C which are substantially equal in cross-sectional flow area to the flow space A provided by the interior of the tube 302.

The intermediate member 312 has a first end which is sealingly engaged, such as by welding 318, to an interior surface of the end seal member 310 and a second end portion 314. As shown in FIG. 20, and better shown in FIG. 21, an annular seal and spacer member 316 extends between the tube 302 and the casing 308 adjacent the second end portion 314 of member 312. Member 316 is similar to the inlet end seal member 310 in that it engages and is sealingly affixed, or welded, to the outer periphery of the tube 302.

Whereas the member 310 is an annular member which extends radially outward from the opening to be sealingly engaged to the outer shell 308, the member 316 extends radially outward to sealingly engage the second end portion 314 of the intermediate member 312 to thereby substantially enclose annular chamber B. A spacer means, such as a plurality of tabs 320 are affixed to the member 316 and extend radially outward to engage and preferably be affixed, or welded, to the inner surface of the outer shell 308. This arrangement provides a plurality of fluid flow openings 322 to enable fluid flow through the outer annular chamber or flow space C and out the back of the outer casing.

Sealingly engaged with the outer casing 308 adjacent member 316 is an axially extending member 324 which is radially outwardly spaced from tube 302. The member 324 completely envelops a longitudinal portion of the tube 302 and forms an annular fluid flow space D along the outside of the tube 302, substantially as shown in FIG. 22.

Silencer assembly 300 is provided with fluid flow openings 326 in tube 302 adjacent end member 320 and fluid flow openings 328 in intermediate member 316 substantially adjacent the casing end seal member 310. A water inlet member 336, as indicated in phantom lines in FIG. 20 may optionally be provided in outer casing 308 to receive water from an engine, such as the engine 130″ shown in FIG. 15. Alternatively, with the inlet 336 omitted or plugged the assembly 300 may be used with an engine 212 as shown in FIG. 17 in which the water is injected or introduced into the exhaust pipe substantially immediately downstream of the engine.

Regardless of the engine on which it is used, assembly 300 is intended for use inboard of the transom in substantially the same position the silencer assembly 18″ is shown in FIG. 15.

Tube 302 and member 324 would extend rearwardly through an opening in the transom to expell the exhaust gases and entrained water rearward or outboard of the transom.

A valve 340 of substantially the same structure and function as the valve shown and described for FIGS. 1 and 2 is provided in silencer assembly 300. The valve operator rod 342 operatively extends through a wall portion of the member 324 as shown in FIG. 20 to enable appropriate manual or, as shown, power operation of the valve to an opened or, as shown, closed position.

With the valve in the open position, as indicated in phantom, almost all of the exhaust gases will travel straight through the unit through tube 302 and exit outboard of the transom. If the cooling water is introduced into the exhaust pipe adjacent the engine it will be entrained with and accompany the exhaust gases. In those arrangements having a water inlet 336 a portion of the water will travel through chambers C and B to enter chamber A and be introduced to the exhaust gas flow with chamber A formed by tube 302 within assembly 300. Another portion of the water along, with a minimal amount of the exhaust gases, will travel longitudinally through chamber C and openings 322 and chamber D to exit the exhaust systems outboard of the transom. With the valve in the open position the back pressure will be at a minimum for maximum engine performance and the sound level of the exhaust voices will be substantially at a maximum.

Upon closing the valve 340 fluid flow downstream of the valve in tube 302 is substantially prevented. The fluid flow, as indicated by the flow arrows in FIG. 20, is forced to travel radially outward through the openings 326 and longitudinally along chamber B to enter chamber C by flowing radially outward through openings 328. The exhaust gases and water then flow longitudinally through chamber C to exit the chamber through openings 322 and enter elongated annular flow chamber D and flow rearward to exit the exhaust system outboard or rearwardly of the transom. In the valve closed mode back pressure on the engine is moderately increased and the sound level of the exhaust is minimized to enable good power performance and relatively quiet operation of the boat, as desired or required.

While particular embodiments of this invention have been shown and described, it will be obvious to those skilled in the art that various changes and modifications may be made therein without departing from the spirit and scope of the invention and, therefore, it is intended in the appended claims to cover all such changes and modifications which fall within the true spirit and scope of the invention.

What is claimed is:

1. An improved wet-type exhaust silencer for a water cooled, internal combustion engine for a power boat, that is being operated in a body of water, in which cooling water from the body of water is injected into and mixed with the high-pressure, hot exhaust gases issuing from an exhaust pipe for the engine;

the improved silencer comprising, in combination:

an axially elongated first tube with an open inlet end adapted to be sealingly connected to the outer surface of the engine exhaust pipe carrying high temperature, high-pressure, exhaust gas being discharged from said engine;

an axially elongated second tube means surrounding a portion of said first tube and being connected thereto, said second tube being spaced radially outwardly from said first tube to define a first axially elongated annular chamber located between said first and second tubes;

an axially elongated third tube means surrounding at least a portion of said second tube means and being connected thereto and spaced radially outwardly of said second tube means to define a second axially elongated annular chamber between said second tube means and said third tube means;

water inlet passageway means operatively associated with said second annular chamber for introducing, into said second annular chamber of the silencer, cooling water which is at a cooling temperature that is much below the temperature of the high temperature exhaust gas;

an outlet means, for the mixture of water and exhaust gases issuing from said silencer, through which a mixture of cooled exhaust gas and heated cooling water is discharged from the silencer downwardly into said body of water in which the high-powered speedboat is operating, so as to reduce the noise of the exhaust gases issuing from the silencer; andS flow aperture means provided in the surrounded portion of each of said first and second tube means and cooperating with the two axially elongated chambers, one provided between said third tube and second tube and the other provided between said second tube and first tube, for providing a circuitous flow path through said silencer which operates to cause cooling water to intimately mix with the exhaust gases before both are discharged from the silencer.

2. An exhaust silencer as in claim 1 wherein the axially elongated first, second and third tubes terminate in a common wall that lies transversely to the axes of all three tubes.

3. An exhaust silencer as in claim 1 wherein the first tube has an open downstream end through which a mixture of exhaust gases and cooling water may be discharged.

4. An exhaust silencer as in claim 1 wherein the first tube has an open downstream end relative to the direction of movement of fluid from the silencer; said downstream end being provided with a selectively pivotable fluid flow blocking means in the form of a circular valve plate mounted on a pivot shaft that extends diametrically across the first tube.

5. An exhaust silencer as in claim 1 wherein the outlet means includes an exit opening through the wall of the axially elongated third tube means, and through which a mixture of exhaust gases and cooling water may be discharged.

6. An exhaust silencer as in claim 1 wherein the water inlet passageway means that is operatively associated with the second annular chamber is located in the axially elongated third tube means adjacent the inlet end of the exhaust silencer for receiving exhaust gases from the engine.

7. An exhaust silencer as in claim 5 wherein the exit opening through said third tube means is surrounded by a radially outwardly extending flow directing wall.

8. An exhaust silencer as in claim 7 wherein the outlet means for the mixture of cooling water and exhaust gas from said silencer is located in the axially elongated third tube means and spaced substantially opposite the water inlet passageway means to the silencer.

9. An exhaust silencer as in claim 1 wherein flow aperture means within the silencer, provided in a surrounded portion of said first or second tubes, is in the form of a set of circumferentially disposed openings.

10. An exhaust silencer as in claim 9 wherein the circumferentially disposed openings are axially elongated slots.

11. An exhaust silencer as in claim 9 wherein the circumferentially disposed openings in the first tube means are axially offset relative to the openings in the second tube means.

12. An exhaust silencer as in claim 11 wherein the circumferentially disposed openings are each axially elongated.

13. An exhaust silencer as in claim 4 wherein the pivotable valve plate has a first position for blocking flow and a second position for permitting flow, and detent means are provided operatively associated with the pivotable valve plate on the pivot shaft for selectively holding the valve plate in either one of said pair of selected altitudes.

14. An exhaust silencer as in claim 1 wherein the internal combustion engine is provided with a water jacket for cooling the engine, the water jacket having a water take off connection extending to the water inlet passageway means through the wall of said third tube means of the silencer; and a pump for forcing water, from the body of water in which the boat is operating, through said water jacket and to the water inlet passageway means through the wall of said third tube means.

15. An exhaust silencer as in claim 1 wherein the axially elongated first tube, the axially elongated second tube means, and the axially elongated third tube means are generally cylindrical in cross section and are positioned concentric with respect to each other.

16. An exhaust silencer as in claim 15 wherein the first, second and third tubes are of relative diameters to each other so that the cross-sectional area of the first tube, first annular chamber and second annular chamber are substantially equal.

17. An exhaust silencer as in claim 15 wherein the cumulative cross-sectional area of the flow aperture means between the first tube and the first annular chamber, and between the first and second annular chambers, both are substantially equal to the cross-sectional area of the first tube.

18. An exhaust silencer as in claim 1 wherein the third tube exhaust port is of a cross-sectional area that is substantial equal to the cross-sectional area of the second chamber.

19. In a wet-type exhaust silencer for a water cooled, internal combustion engine for a power boat being operated in a body of water, in which cooling water is injected into and mixed with the high-pressure, hot exhaust gases of the engine as the exhaust gases pass from the engine through an engine exhaust pipe to a silencer;

an improved silencer comprising, in combination:

an axially elongated first tube with an open inlet end adapted to be sealingly connected to the inner surface of the engine exhaust pipe carrying high temperature, high-pressure, exhaust gas being discharged from said engine;

an axially elongated second tube means surrounding a portion of said first tube, and having its ends connected to a wall of the first tube, said elongated second tube means being spaced radially outwardly from, and concentric with, said first tube to define a first axially elongated annular chamber located between said first and second tubes;

an axially elongated third tube means surrounding at least a portion of said second tube means and being connected thereto and spaced radially outwardly of said second tube means to define a second axially elongated annular chamber between said second tube means and said third tube means;

a water inlet passageway means operatively associated with said second annular chamber for introducing cooling water, which is at a cooling temperature that is much cooler than the temperature of the high temperature exhaust gas, into said second annular chamber of the silencer;

a open outlet end for the first tube, spaced axially rearwardly of the second tube means and through which a mixture of high temperature exhaust gas and heated cooling water is discharged from the silencer so as to reduce the noise of exhaust gases issuing from the silencer; and axially elongated flow apertures provided in portions of each of said first and second tube means that are surrounded by other tube means, said flow apertures in the second tube means being axially offset with respect to the apertures in the first tube means, the arrangement of apertures in the first and second tube means cooperating with the axially elongated chambers defined both between said third tube and second tube and between said second tube and first tube, for providing a circuitous flow path through said silencer which operates to cause cooling water to intimately mix with the exhaust gas before both are discharged from the silencer.

20. In a wet-type exhaust silencer for a water cooled, internal combustion engine for a power boat being operated in a body of water, and into which silencer cooling water is to be injected to be mixed with the high-pressure, hot exhaust gases of the engine as the exhaust gases pass from an engine exhaust pipe to the silencer;

the improvement comprising, in combination:

an axially elongated first tube with an open inlet end adapted to be sealingly connected to the outer surface of the engine exhaust pipe carrying high temperature, high-pressure, exhaust gas being discharged from said engine;

an axially elongated second tube means surrounding a portion of said first tube and being connected thereto and spaced radially outwardly from said first tube to define a first axially elongated annular chamber located between said first and second tubes;

an axially elongated third tube means surrounding at least a portion of said second tube means and being connected thereto and spaced radially outwardly of said second tube means to define a second axially elongated annular chamber between said second tube means and said third tube means;

means for conveying cooling water from the engine into the elongated first tube;

an outlet means for a mixture of water and exhaust gases from said silencer, through which a mixture of high temperature exhaust gas from the engine, and heated cooling water from the engine, are discharged as a mixture from the silencer downward toward said body of water in which the high-powered speedboat is operating, so as to reduce the noise of exhaust gases issuing from the silencer; and flow aperture means provided in the surrounded portion of each of said first and second tube means and cooperating with the axially elongated chambers defined both between said third tube and second tube and between said second tube and first tube, for providing a circuitous flow path through said silencer which operates to cause cooling water to intimately mix with the exhaust gas before both are discharged from the silencer.

21. In a wet-type exhaust silencer for a water cooled, internal combustion engine for a power boat being operated in a body of water, in which cooling water is injected into and mixed with the high-pressure, hot exhaust gases of the engine by a water inlet means as the exhaust gases pass through an engine exhaust pipe to the silencer;

the improved silencer comprising, in combination:

an axially elongated first tube with an open inlet end adapted to be sealingly connected to the outer surface of the engine exhaust pipe carrying high temperature, high-pressure, exhaust gas being discharged from said engine;

an axially elongated second tube means surrounding a portion of said first tube and being connected thereto and spaced radially outwardly from said first tube to define a first axially elongated annular chamber located between said first and second tubes;

an axially elongated third tube means surrounding at least a portion of said second tube means and being connected thereto and spaced radially outwardly of said second tube means to define a second axially elongated annular chamber between said second tube means and said third tube means;

a first tube open outlet end extension located rearward of the second tube means and said extension being provided with a selectively pivotable fluid flow blocking means in the form of a circular valve plate mounted on a pivot shaft that lies diametrically of the first tube;

a fourth tube means extending axially rearward from said third tube means surrounding at least a portion of the first tube outlet end extension to define an outlet passageway between said fourth tube means and said first tube outlet extension means;

an outlet aperture means providing a connection between said third and fourth tube means, so as to provide communication between said second axially elongated chamber and said outlet passageway; and flow aperture means provided in the surrounded portion of each of said first and second tube means and cooperating with the axially elongated chambers defined both between said third tube and second tube and between said second tube and first tube, for providing a circuitous flow path through said silencer which operates to cause cooling water to intimately mix with the exhaust gas before both are discharged from the silencer.

* * * * *